US009027313B2

(12) United States Patent
Copp et al.

(10) Patent No.: US 9,027,313 B2
(45) Date of Patent: May 12, 2015

(54) APPARATUS FOR DIVIDING HEAT-SHRINKABLE PLASTIC FILM INTO DIFFERENT TEMPERATURE REGIONS

(75) Inventors: Timothy M. Copp, Danbury, CT (US); G. Taylor Richey, HopewellJct., NY (US)

(73) Assignee: Reelex Packaging Solutions, Inc., Patterson, NY (US)

( * ) Notice: Subject to any disclaimer, the term of this patent is extended or adjusted under 35 U.S.C. 154(b) by 492 days.

(21) Appl. No.: 13/506,574

(22) Filed: Apr. 30, 2012

(65) Prior Publication Data

US 2013/0283735 A1 Oct. 31, 2013

(51) Int. Cl.
*B65B 53/02* (2006.01)
*B65B 53/06* (2006.01)

(52) U.S. Cl.
CPC ..... *B65B 53/02* (2013.01); *B65B 53/063* (2013.01); *B65B 53/06* (2013.01)

(58) Field of Classification Search
CPC ..... B64B 53/00; B64B 53/02; B64B 53/06; B64B 53/063
USPC ..... 53/442, 557, 556, 413, 134.1; 432/121, 432/128, 129, 143, 152, 155; 34/653, 655, 34/635
See application file for complete search history.

(56) References Cited

U.S. PATENT DOCUMENTS

| | | | |
|---|---|---|---|
| 1,463,181 | A | 7/1923 | Vorderwinkler |
| 1,529,816 | A | 3/1925 | Stenglein |
| 2,388,557 | A | 11/1945 | Little et al. |
| 2,459,747 | A | 1/1949 | Kolbe |
| 2,634,918 | A | 4/1953 | Taylor et al. |
| 2,634,922 | A | 4/1953 | Taylor |
| 2,650,036 | A | 8/1953 | Berkepeis |
| 2,738,145 | A | 3/1956 | Taylor |
| 2,767,938 | A | 10/1956 | Taylor |

(Continued)

FOREIGN PATENT DOCUMENTS

| | | |
|---|---|---|
| DE | 532861 | 9/1931 |
| GB | 2089761 | 6/1982 |
| JP | 2004217237 | 8/2004 |

OTHER PUBLICATIONS

U.S. Appl. No. 13/506,545; Timothy M. Copp et al, filed Apr. 27, 2012; "Proflex" Shrink Bag with Handle & Handle Isolation Apparatus.

(Continued)

*Primary Examiner* — Thanh Truong
*Assistant Examiner* — Dianne Mitchell
(74) *Attorney, Agent, or Firm* — Gordon & Jacobson, PC

(57) ABSTRACT

Apparatus and a process for dividing heat-shrinkable plastic film into different temperature regions within a shrink wrap oven including a movable platform; a cylindrical tube immovably mounted within the oven in the direction of movement of the platform and including a platform for supporting a portion of the heat-shrinkable plastic film and a slit running the length of said cylindrical tube; a package covered with heat shrinkable plastic film and including that portion of the heat-shrinkable plastic film resting on the platform adjacent the cylindrical tube; an electric fan mounted at the opposite end of the cylindrical tube containing the platform and sucking ambient air through the cylindrical tube to cool that portion of the heat-shrinkable plastic film as the heat-shrinkable plastic film is tightly shrunk around the package.

10 Claims, 2 Drawing Sheets

(56) References Cited

U.S. PATENT DOCUMENTS

| | | | | | |
|---|---|---|---|---|---|
| 2,929,569 | A | | 3/1960 | Detrick et al. | |
| 2,943,732 | A | | 7/1960 | Kovaleski et al. | |
| 2,971,709 | A | | 2/1961 | Ellis | |
| 3,061,238 | A | | 10/1962 | Taylor | |
| 3,150,769 | A | | 9/1964 | Cohn | |
| 3,178,130 | A | | 4/1965 | Taylor | |
| 3,190,050 | A | * | 6/1965 | Kirkpatrick | 53/398 |
| 3,357,153 | A | * | 12/1967 | Shaffer | 53/442 |
| 3,589,096 | A | | 6/1971 | Podvin | |
| 3,643,987 | A | | 2/1972 | DuPont | |
| 3,655,140 | A | | 4/1972 | Gordon et al. | |
| 3,666,200 | A | | 5/1972 | Newman et al. | |
| 3,668,817 | A | * | 6/1972 | Bell | 53/397 |
| 3,677,490 | A | | 7/1972 | Gordon et al. | |
| 3,677,491 | A | | 7/1972 | Gerwig | |
| 3,747,861 | A | | 7/1973 | Wagner et al. | |
| 3,748,817 | A | | 7/1973 | Newman | |
| 3,812,640 | A | | 5/1974 | Knott | |
| 3,877,653 | A | | 4/1975 | Foltyn et al. | |
| 3,923,270 | A | | 12/1975 | Newman et al. | |
| 3,980,244 | A | | 9/1976 | Pietroni | |
| 3,982,712 | A | | 9/1976 | Bassett | |
| 3,985,315 | A | | 10/1976 | Newman | |
| 4,009,845 | A | | 3/1977 | Santucci et al. | |
| 4,019,636 | A | | 4/1977 | Wise | |
| 4,022,399 | A | | 5/1977 | Zajac | |
| 4,057,203 | A | | 11/1977 | Newman et al. | |
| 4,057,204 | A | | 11/1977 | Zajac | |
| 4,085,902 | A | | 4/1978 | Wagner | |
| 4,098,467 | A | | 7/1978 | Engmann et al. | |
| 4,160,533 | A | | 7/1979 | Kotzur et al. | |
| 4,274,607 | A | | 6/1981 | Priest | |
| 4,283,020 | A | | 8/1981 | Bauer et al. | |
| 4,285,157 | A | | 8/1981 | Lambert | |
| 4,313,579 | A | | 2/1982 | Zuber et al. | |
| D267,394 | S | | 12/1982 | Liptak et al. | |
| 4,367,853 | A | | 1/1983 | Kotzur | |
| 4,373,687 | A | | 2/1983 | Zicko | |
| 4,406,419 | A | | 9/1983 | Kotzur | |
| 4,477,033 | A | | 10/1984 | Kotzur et al. | |
| 4,523,723 | A | | 6/1985 | Kotzur | |
| 4,535,587 | A | | 8/1985 | Rias | |
| 4,555,025 | A | * | 11/1985 | Weinberg et al. | 206/497 |
| 4,555,895 | A | * | 12/1985 | Torre | 53/557 |
| D285,176 | S | | 8/1986 | Kodousek et al. | |
| 4,637,564 | A | | 1/1987 | Hallenbeck et al. | |
| 4,700,528 | A | | 10/1987 | Bernard | |
| 4,792,100 | A | | 12/1988 | Pepe | |
| 4,817,796 | A | | 4/1989 | Camillo et al. | |
| 4,884,764 | A | | 12/1989 | Hill | |
| 4,956,963 | A | | 9/1990 | Johnson | |
| 5,042,739 | A | | 8/1991 | Zajac | |
| 5,053,795 | A | | 10/1991 | Wyman | |
| 5,115,995 | A | | 5/1992 | Hunt | |
| 5,121,584 | A | | 6/1992 | Suter | |
| 5,150,789 | A | | 9/1992 | Bass | |
| 5,150,852 | A | | 9/1992 | Hunt et al. | |
| 5,203,139 | A | | 4/1993 | Salsburg et al. | |
| D341,777 | S | | 11/1993 | Sheu | |
| D348,392 | S | | 7/1994 | Tannen | |
| 5,354,193 | A | * | 10/1994 | Kupcikevicius | 425/403 |
| 5,368,245 | A | | 11/1994 | Fore | |
| 5,398,427 | A | * | 3/1995 | Tolson | 34/389 |
| 5,470,026 | A | | 11/1995 | Kotzur | |
| 5,499,775 | A | | 3/1996 | Vander Groef | |
| 5,520,347 | A | | 5/1996 | Bass et al. | |
| 5,529,186 | A | | 6/1996 | Bass | |
| 5,593,035 | A | | 1/1997 | Taylor et al. | |
| 5,624,528 | A | | 4/1997 | Abrams et al. | |
| 5,678,778 | A | | 10/1997 | Kotzur et al. | |
| 5,714,936 | A | | 2/1998 | Regelsberger | |
| 5,740,659 | A | * | 4/1998 | Cox et al. | 53/442 |
| D396,632 | S | | 8/1998 | Lee | |
| 5,803,394 | A | | 9/1998 | Kotzur et al. | |
| 5,810,272 | A | | 9/1998 | Wallace et al. | |
| D400,096 | S | | 10/1998 | Lee | |
| D406,753 | S | | 3/1999 | Lee | |
| 5,938,260 | A | | 8/1999 | Wallace et al. | |
| 5,941,050 | A | | 8/1999 | Georgetti et al. | |
| 5,979,812 | A | | 11/1999 | Kotzur et al. | |
| 6,003,667 | A | | 12/1999 | Barnett et al. | |
| 6,086,012 | A | | 7/2000 | Kotzur et al. | |
| 6,098,378 | A | | 8/2000 | Wyatt | |
| 6,109,554 | A | | 8/2000 | Kotzur et al. | |
| 6,145,722 | A | | 11/2000 | Behrens et al. | |
| 6,151,871 | A | * | 11/2000 | Torre | 53/557 |
| 6,276,623 | B1 | | 8/2001 | Williams | |
| 6,341,741 | B1 | | 1/2002 | Kotzur et al. | |
| 6,491,163 | B1 | | 12/2002 | Grcic et al. | |
| 6,702,213 | B2 | | 3/2004 | Kotzur et al. | |
| 6,766,627 | B2 | | 7/2004 | Kotzur et al. | |
| 7,100,346 | B2 | | 9/2006 | Kotzur et al. | |
| D541,145 | S | | 4/2007 | Copp | |
| 7,249,726 | B2 | | 7/2007 | Kotzur | |
| 7,469,520 | B2 | | 12/2008 | Lancaster, III et al. | |
| 8,051,629 | B2 | * | 11/2011 | Pazdernik et al. | 53/442 |
| 8,191,337 | B2 | | 6/2012 | Moore | |
| 2002/0174626 | A1 | | 11/2002 | Lancaster, III et al. | |
| 2004/0123566 | A1 | * | 7/2004 | Limousin | 53/442 |
| 2005/0097862 | A1 | * | 5/2005 | Kotzur et al. | 53/116 |
| 2006/0071115 | A1 | * | 4/2006 | Kotzur | 242/483.9 |
| 2006/0225385 | A1 | | 10/2006 | Biba et al. | |
| 2007/0215505 | A1 | | 9/2007 | Walker | |
| 2007/0272346 | A1 | | 11/2007 | Shpik et al. | |
| 2008/0277523 | A1 | | 11/2008 | Delmore | |
| 2010/0139211 | A1 | * | 6/2010 | Moore | 53/204 |
| 2012/0110955 | A1 | * | 5/2012 | Rekieta et al. | 53/430 |
| 2013/0284851 | A1 | | 10/2013 | Copp et al. | |

OTHER PUBLICATIONS

U.S. Appl. No. 13/506,574; Timothy M. Copp et al, filed Apr. 30, 2012; Apparatus for Dividing Heat-Shrinkable Plastic Film into Different Temperature Regions.

Proflex. Datasheet; (online) Reelex Packaging Solutions, Apr. 14, 2012, available at www.reelex.com/Packaging/ProFlex.html.

* cited by examiner

APPARATUS FOR DIVIDING HEAT-SHRINKABLE PLASTIC FILM INTO DIFFERENT TEMPERATURE REGIONS

BACKGROUND OF THE INVENTION

Field of the Invention

This invention relates to apparatus for dividing heat-shrinkable plastic film into different temperature regions, for example one section of the heat-shrinkable plastic film has heat applied and another section of the film is isolated and maintained at a cooler temperature when passing through a heat shrink oven, for example. This allows a single shrink-wrap material to assume the characteristics of a shrunk portion and a non-shrunk portion.

The plastic film is shrunk over packages to secure the contents of the package and prevent damage to the contents of the package. Coils of wound filament material are often packaged in this manner. The invention has application to shrunk wrap packages in general and specifically to shrunk wrap packages of wound filament material wound in a figure-eight configuration known to the trade as a REELEX package.

SUMMARY OF THE INVENTION

An insulating barrier against the high temperatures typical of a heat shrink oven used to shrink wrap packages is achieved by a cylindrical tube mounted within the heat shrink oven and with a slit running along its entire length. At one end of the cylindrical tube a small section is cut away to provide a platform for resting a portion of the plastic shrink-wrap film prior to entry of the package into the shrink wrap oven and entry of the portion of the shrink wrap material into the slit in the cylindrical tube. The package and the portion of the film entering into the slit in the cylindrical tube travel the length of the oven together. An electric-operated cooling fan is mounted on the opposite end of the cylindrical tube. The fan forces cooler ambient air through the length of the cylindrical tube thereby maintaining a temperature inside the tube low enough to prevent shrinkage of that portion of the plastic shrink-wrap film as it passes through the cylindrical tube.

The cylindrical tube is then placed lengthwise inside the heat shrink oven, with the slit in the cylindrical tube facing towards the center of the oven. To operate the apparatus the electrical fan is switched on as the oven is turned on to suck ambient air into the end of the cylindrical tube with the platform and decreasing the temperature inside the cylindrical tube compared to the temperature inside the plastic shrink-wrap oven.

The portion of the plastic shrink-wrap film to be isolated from the heat of the oven is placed into the slit in the cylindrical tube and remains there the entire time the film and the package is inside the oven, thereby enabling the portion of the shrink-wrap film outside the tube to shrink and the portion of the shrink-wrap film inside the cylindrical tube to remain in its pre-shrunk form.

BRIEF DESCRIPTION OF THE DRAWINGS

The above objects, features and advantages of the invention are readily apparent from the following description of a preferred embodiment of the best mode of carrying out the invention when taken in conjunction with the following drawings, wherein.

DETAILED DESCRIPTION

Figure 1:
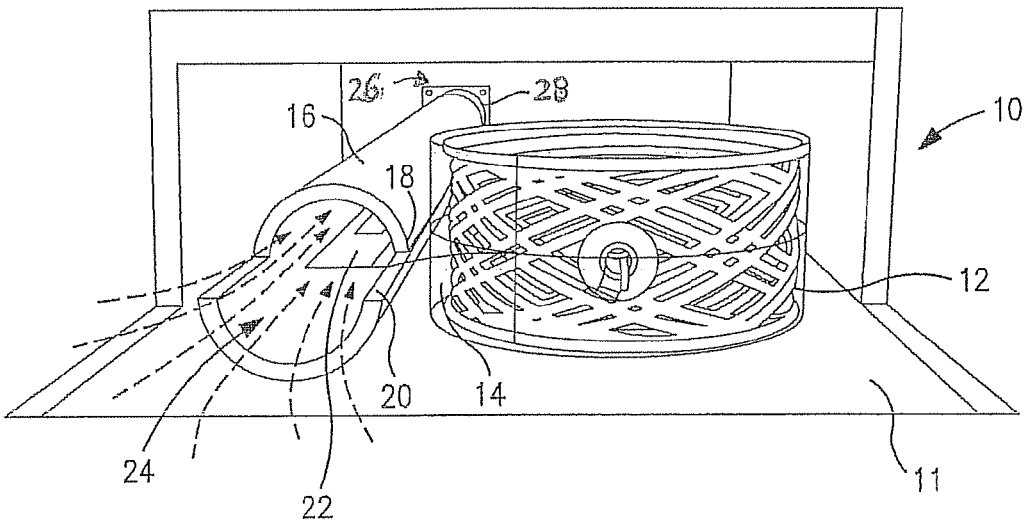
FIG. 1 is a front view of a heat shrink apparatus with a cylindrical tube positioned the full length of the heat shrink oven and showing a slit running the full length of the cylindrical tube and a platform formed at the entry end of the cylindrical tube. A package to be encased with shrink wrap film is placed in the heat shrink wrap oven alongside the cylindrical tube.

In FIG. 1 heat shrink wrap oven 10 includes platform 11 for supporting package 12 covered by a layer of shrink wrap film 14 which is to tightly cover the package 12 after its passage through the heat shrink wrap oven 10. Cylindrical tube 16 is mounted above and parallel to platform 11 and runs the length of the heat shrink wrap oven 10 as shown in FIG. 1. Cylindrical tube 16 has a slit 18 cut into its side that runs the length of the tube. A platform 20 is cut into the end of the cylindrical tube 16 enabling a portion 22 of the shrink wrap film 14 to rest on platform 20 prior to being fed into slit 18. Portion 22 of the shrink wrap film can be a handle or some other portion of the shrink wrap film 14 that is desired to be maintained cooler than the shrink wrap material surrounding the wound package.

FIG. 1 also depicts the flow of air into the platform end of the cylindrical tube 16 that is created by an electrical fan 28 mounted at the far end of the platform 20 on the cylindrical tube 16.

It is to be understood that while the invention ha general application to packages wound with shrink wrap material and to include a section that has no preshrunk material as described above, the invention has particular application to packages of coils wound in a figure eight configuration such as the REELEX packages known to the wound filament material trade.

Figure 2:
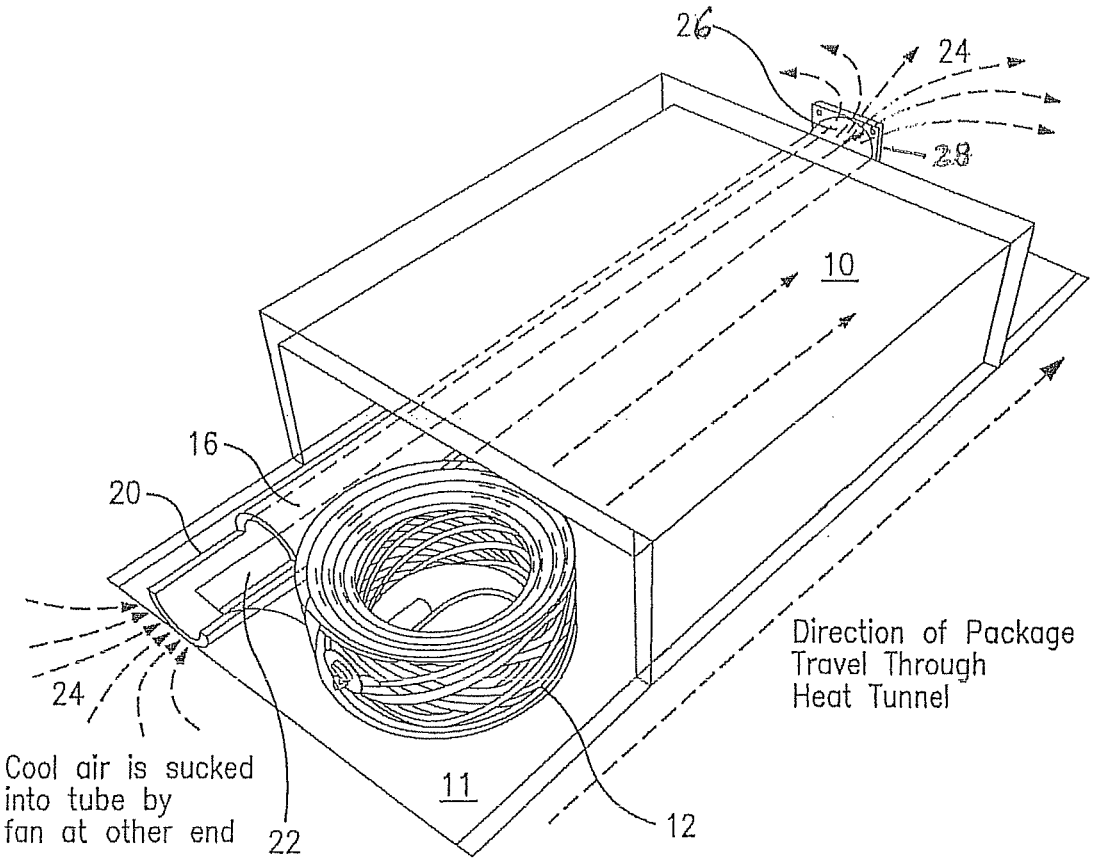
FIG. 2 is an isometric view of the heat sink oven illustrating the suction of cool air into the cylindrical tube; the flow of ambient air through the cylindrical tube and exiting at the far end of the tube; the placement of the package having a portion (handle) being placed in the slit in the cylindrical tube; and the movement of the package and the portion of the shrink wrap filament placed in the slit running the length of the heat shrink wrap oven.

In the isometric view of FIG. 2, package 12 is shown placed on platform 11 of the heat shrink wrap oven 10 in a position beside cylindrical tube 16 with handle 22 resting on platform 20 and engaged in the slit 18 of the cylindrical tube 16. An electrical fan 28 mounted in the end portion 26 of the cylindrical tube 16 sucks cool air 24 into the end of the cylindrical tube 16 having the platform 20 and out of the far end 26 of the cylindrical tube as the package and filament material in the oven move through the oven as shown in FIG. 2.

From the above description it is readily apparent that the invention provides apparatus for dividing heat-shrinkable plastic film into different temperature regions, for example one section of the heat-shrinkable plastic film has heat applied and another section of the film is isolated and maintained at a cooler temperature when passing through a heat shrink oven, for example. This allows a single shrink-wrap material to assume the characteristics of a shrunk portion and a non-shrunk portion.

The invention claimed is:

1. An apparatus for dividing heat-shrinkable plastic film into different temperature regions within a shrink wrap oven, comprising:

a movable platform of the shrink wrap oven;

a cylindrical tube immovably mounted within said oven, said tube extending longitudinally from a first end to a second end in the direction of movement of said movable platform, said cylindrical tube including a tube platform at the first end for supporting a portion of the heat-shrinkable plastic film and a slit running the length of said cylindrical tube;

a package covered with heat shrinkable plastic film and including said portion of the heat-shrinkable plastic film resting on said tube platform adjacent said cylindrical tube;

an electric fan mounted at the second end of said cylindrical tube opposite said first end, said fan sucking ambient air through said cylindrical tube to cool said portion of the heat-shrinkable plastic film as the rest of the package's heat-shrinkable plastic film is tightly shrunk around said package while the whole package moves through said shrink wrap oven.

2. The apparatus according to claim 1, wherein said package is a wound coil of filamentary material.

3. The apparatus according to claim 2, wherein said wound coil of filamentary material is a coil wound in a figure-eight configuration.

4. A process for dividing heat-shrinkable plastic film into different temperature regions within a shrink wrap oven, comprising:

providing a movable platform of said shrink wrap oven;

immovably mounting a cylindrical tube within said oven, said tube extending longitudinally from a first end to a second end in the direction of movement of said movable platform, said cylindrical tube including a tube platform at the first end for supporting a portion of the heat-shrinkable plastic film and providing a slit running the length of said cylindrical tube;

covering a package with heat shrinkable plastic film and resting said portion of the heat-shrinkable plastic film on said tube platform adjacent said cylindrical tube;

mounting an electric fan at the second end of said cylindrical tube opposite said first end and sucking ambient air through said cylindrical tube to cool said portion of the heat-shrinkable plastic film as the rest of the package's heat-shrinkable plastic film is tightly shrunk around said package while the whole package moves through said shrink wrap oven.

5. The process according to claim 4, wherein said package is a wound coil of filamentary material.

6. The process according to claim 5, wherein said wound coil of filamentary material is a coil wound in a figure-eight configuration.

7. A system, comprising:

a heat-shrinkable plastic film having a handle portion;

an object around which said heat-shrinkable plastic film is to be shrunk; and a shrink wrap oven having a movable platform sufficient to support said object and move said object through said shrink wrap oven, said shrink wrap oven having a stationary tube mounted therein and extending longitudinally from a first end to a second end in the direction of movement of said movable platform, said tube having a slit running the length of said tube and adapted to receive said handle portion of said heat-shrinkable plastic film, and a fan coupled to said tube and arranged to suck ambient air through said tube to cool said handle portion as the remainder of said plastic film is tightly shrunk around said object moving through said shrink wrap oven.

8. The system according to claim 7, wherein:

said stationary tube comprises a tube platform at said first end for supporting a portion of said plastic film.

9. The system according to claim 7, wherein:

said shrink wrap oven has first and second parallel sides, said stationary tube is mounted toward said first side of said oven, and said slit faces said second side of said oven.

10. The system according to claim 7, wherein:

said object is a wound coil of filamentary material.

* * * * *